US005720111A

United States Patent [19]

McMullen

[11] Patent Number: 5,720,111

[45] Date of Patent: Feb. 24, 1998

[54] BORESIGHT

[76] Inventor: Kieran Eugene McMullen, Rte. 2, Box 158, Rush Springs, Okla. 73082

[21] Appl. No.: 588,626

[22] Filed: Jan. 19, 1996

[51] Int. Cl.[6] ..... F41G 1/00

[52] U.S. Cl. ..... 33/234

[58] Field of Search ..... 33/234, 235, 533; 42/100

[56] References Cited

U.S. PATENT DOCUMENTS

| | | | |
|---|---|---|---|
| 793,131 | 6/1905 | Henkes | 33/234 |
| 962,175 | 6/1910 | Straubel | 33/234 |
| 2,463,200 | 3/1949 | Pitzer | 33/235 |
| 2,773,309 | 12/1956 | Elliott | 33/234 |
| 4,057,905 | 11/1977 | Piaja | 33/234 |
| 4,090,305 | 5/1978 | Cassidy | 33/234 |
| 4,534,116 | 8/1985 | Davis | 33/234 |
| 5,448,834 | 9/1995 | Huang | 33/234 |

*Primary Examiner*—G. Bradley Bennett
*Attorney, Agent, or Firm*—Sidley & Austin

[57] ABSTRACT

A boresight assembly for artillery having one or more baffles defining a central passageway and a perimeter passageway with a sighting periscope receivable within the passageway.

9 Claims, 3 Drawing Sheets

BORESIGHT

TECHNICAL FIELD OF THE INVENTION

The present invention relates to an accessory device for artillery pieces. In particular, the present invention relates to a boresight device for sighting of an artillery piece.

BACKGROUND OF THE INVENTION

Modern artillery pieces are generally employed as indirect fire weapons. Indirect fire weapons are weapons used against targets which cannot be seen from the artillery piece. Although the primary use of most modern artillery pieces is in the indirect fire mode, it is also desirable for such weapons to be capable of use in the direct fire mode. Direct fire meaning that operators of the weapon can see the target from the weapon and fire directly on the target. The direct fire mode, while not being the typical mode of employment, is an important element in self defense of the weapon and its crew.

In the indirect fire mode, the direction of fire for the artillery piece is determined from information provided by a forward observer. Usually, the forward observer is not located in a position which is along a line drawn from the artillery piece to the target. Thus, calls for fire from the forward observer are sent to a fire direction control center which plots the target location provided by the observer. The fire direction control center then computes the direction and range to the target from the artillery piece. After the first round is fired, the observer watches for impact and calls in corrections. The fire direction control center then computes any needed corrections to bring fire onto the target.

Since the artillery piece can be pointed in a number of directions, it must have an established base direction from which to measure the direction to the forward observer. This is provided by the primary line of fire of the battery which is the most likely direction in which it will fire. Thus, the artillery piece is provided an aiming stake, infinity colimeter, distance aiming point or some other reference point to align the common tube in the most likely direction of fire. This reference point, together with the pivot point of the artillery piece barrel, defines a line which is the primary axis of fire. Angles to the forward observer and to the target are then measured from this line. Thus, the accuracy of the artillery piece is a function of the precision with which the axis of the barrel can be aligned with the reference point. If the sights of the artillery piece are not properly aligned with the true axis of the bore of the artillery piece, accuracy will suffer. The error will increase as the range to the target increases. Thus, aligning the sighting apparatus of the artillery piece with the actual axis of the bore of the artillery piece is of utmost importance.

In addition, cannon must be able to have the projectile they fire clear intervening objects between the muzzle of the cannon and the target. One of the methods used to do this is a standard report rendered by the soldier in charge of each cannon in which the soldier verifies the lowest elevation a cannon tube can be fired at from a particular firing position. The common test to determine minimum firing elevation requires the soldier to look over the lower edge of the inside of the cannon barrel bore from breech to muzzle without the aid of any device. The cannon tube is elevated or depressed and traversed left or right while the soldier looks down the bottom inside edge of the cannon's bore. This method suffers in that the soldier's unaided eye can wander and his view may not be held parallel to the lower edge of the bore. This method of determining minimum elevation from a firing position cannot be accomplished in cannons that have limited access to the breech.

Boresighting disks have been used to provide alignment. There is currently no device used to determine minimum elevation. The present invention provides a boresight having advantages of easy assembly, disassembly and easy use with guns having limited access to the breach of the piece, and for the first time a boresight which can be aligned with the bottom edge of the bore.

SUMMARY OF THE INVENTION

In one aspect, the present invention relates to a sighting periscope support assembly having one or more baffles defining a central aperture and alignment surfaces on the outer perimeter of the baffle dimensioned to slidably engage the inter diameter of the bore of the artillery piece. The baffles also can define one or more perimeter passageways. Additionally, the baffles may define one or more channels to receive connecting members.

In one embodiment the sighting periscope support assembly is a single baffle defining a central passageway and a perimeter passageway. The baffle has one or more alignment surfaces on the outside wall for slidable contact with the bore of an artillery piece. The diameter of the baffle is sufficient to provide a stable fit within the bore, and has a length of about one half or more times the diameter of the bore. A periscope is provided dimensioned to fit within the central passageway and perimeter passageway to provide sighting of the piece.

In another embodiment of the invention, the periscope support assembly has two or more baffles, each defining a central aperture and a plurality of channels to receive connecting members, two or more connecting members connect the baffles. Preferably at least one of the connecting members is hollow such that it will receive the telescope. Alternatively the baffles also define a perimeter passageway which can receive the periscope.

In another embodiment the invention relates to a boresight assembly comprising the support assembly and the periscope in combination. The periscope is slidably receivable within the center aperture of a baffle, and within the perimeter passageway or hollow connecting member.

BRIEF DESCRIPTION OF THE DRAWINGS

The present invention will be described in reference to its preferred embodiments, a better of understanding of which can be obtained from reading the detailed description in conjunction with the figures.

DETAILED DESCRIPTION

Figure 1:
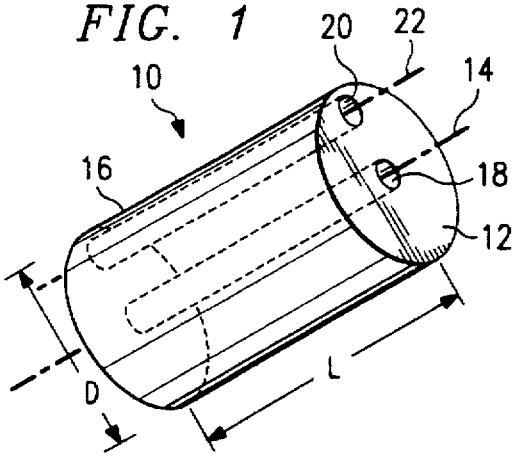
FIG. 1 is an isometric view of a first embodiment of a single baffle support assembly device.

In a first embodiment shown in FIG. 1, a periscope support assembly 10 is shown. Support 10 is a baffle member 12 having an axis 14 and defines an outer wall 16 having a length "L" and a predetermined diameter "D". The member 12 also defines a center passageway 18 concentric with axis 14 and at least one perimeter passageway 20 which is adjacent to outer wall 16 and has an axis 22 parallel to center axis 14. Like members in the various Figures refer to the same item as in another Figure.

Figure 2:
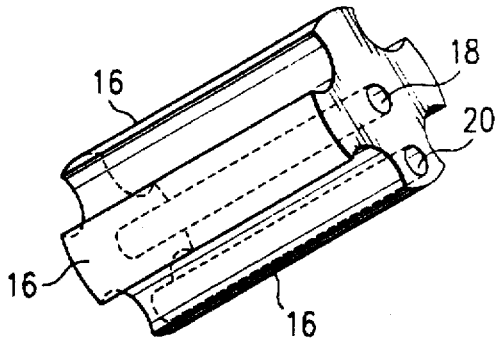
FIG. 2 is an isometric view of a second embodiment of a single baffle support assembly.

FIG. 2 shows a second embodiment of the device of FIG. 1 wherein like numbers represent like elements. In FIG. 2, outer wall 16 is segmented. The purpose of which is to reduce the area of the outer wall 16 to be reduced and therefore reduce friction, making insertion and removal easier.

Figure 3:
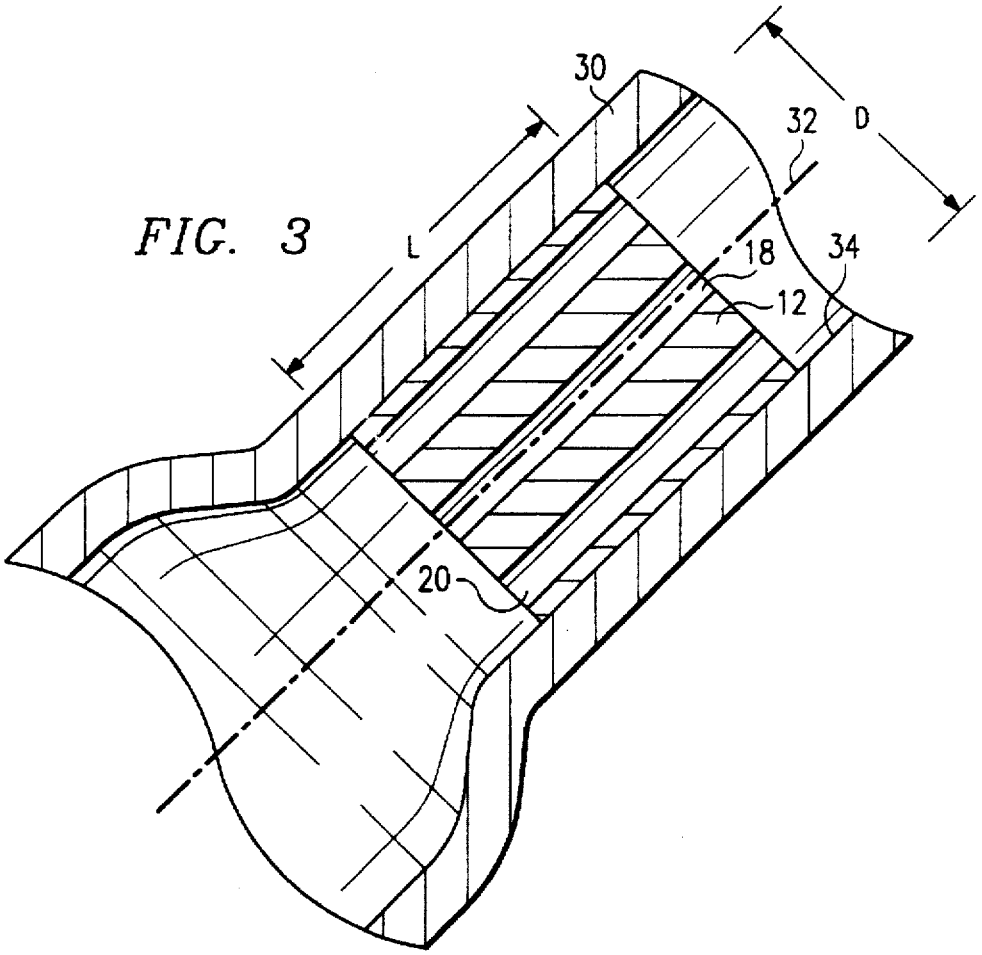
FIG. 3 is a partial cross section of an artillery piece bore and single baffle support assembly.

In FIG. 3 there is shown in partial cross section the bore 30 of artillery piece having a bore axis 32 and defining a bore 34. Baffle member 12 is slidable into the bore 34. The fit should be such that member 12 is slidable in the bore but does not wobble and such that the axis 14 of member 12 is held coincident with the bore axis 32. The length "L" of baffle member 12 should be long enough to provide good alignment, and is generally about two or more times the diameter of the bore "D".

Figure 4:
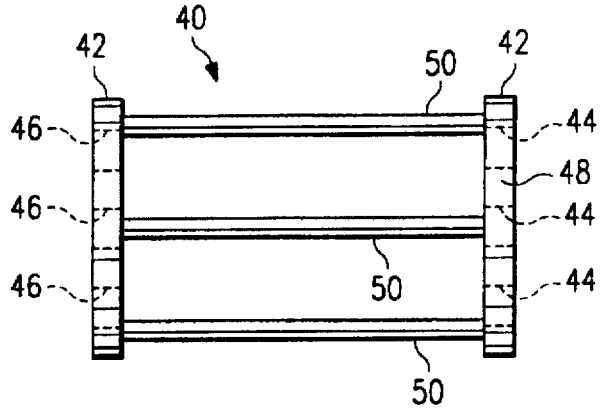
FIG. 4 is a side view of another embodiment of a support assembly.
Figure 5:
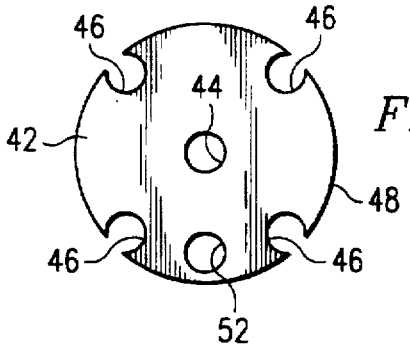
FIG. 5 is an end view of one embodiment of a baffle in the device shown in FIG. 4.

In FIG. 4, the periscope support assembly is shown generally as 40. The support assembly 40 comprises two baffles 42. Although FIG. 4 shows two baffles, more than two may be utilized. Baffles 42 each define a central passageway 44 and have a plurality, preferably three or more, connecting channels 46. Baffle 42 has an outer wall 48. A perimeter passageway 52 may be provided in the baffle adjacent to the outer wall of the baffle. Connecting channel 54 may be in the form of an open channel as illustrated in FIGS. 4 and 5 or as holes. Connecting channels 46 can be adjacent to the outer wall 48. The outer walls 48 of baffles 42 are of a diameter sufficient to achieve a close sliding engagement with the inside walls of the bore of the artillery piece. The outer walls 48 of the baffles 42 should be slightly less than the diameter of the bore to allow insertion and removal from the bore of the artillery piece, but yet be sufficiently tight to avoid lateral displacement perpendicular to the axis of the bore of the artillery piece.

The two baffles 12 are connected by a plurality, preferably three or more, of connecting members 50 (not shown in FIG. 5). The connecting members may be hollow tubes, or solid pieces, or combinations thereof. Connecting members 50 serve to hold baffles 42 spaced apart from one another. The distance which baffles 42 should be spaced apart is that which is sufficient to provide accurate alignment of the central passages 44 of the baffles 42 with the axis of the bore of the artillery piece. Preferably, the length of the connecting members should be at about two times the diameter of the bore or longer. The connecting members may be permanently attached to the baffles, or may be removably attached to the baffles by suitable means such as set screws. Each method of attachment has its own advantages. Removable connecting members allow the boresight to be stowed in less space. However, removable pieces are subject to wear such that fit between the connecting channels and the connecting members may be such that a perpendicular relationship between the baffle and connecting piece may be compromised. Permanently joined baffles and connecting pieces are more difficult to store and also more difficult to repair.

Figure 6:
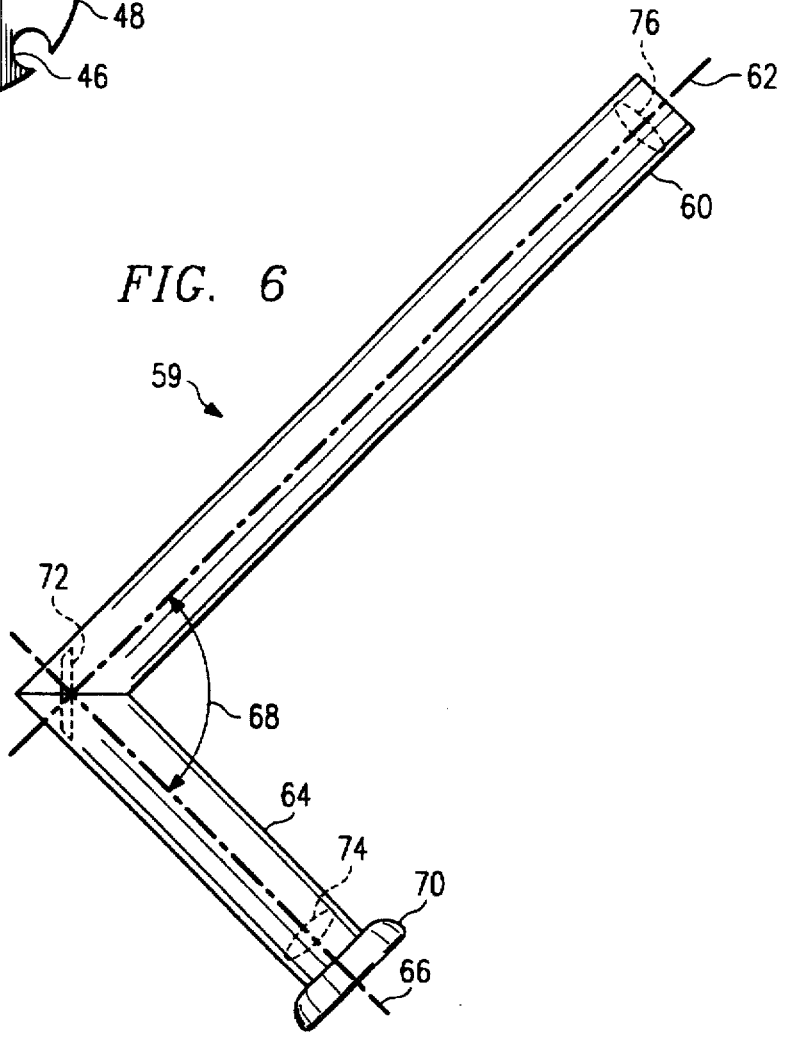
FIG. 6 is a side view of a sighting periscope used in the present invention.

The center passageways 18 and 44 and passageways 20 and 52 should be of sufficient inside diameter to receive a sighting periscope 59. In the multi-baffle design, one of the connecting members 50 can be hollow and have a sufficient inside diameter to receive a sighting periscope. The purpose of the passageways and hole connecting member are to provide receptacles to hold the sighting periscope in a desired alignment. The sighting periscope shown in FIG. 6 comprises a first tube 60 having an axis 62 which is adjoined to a second tube 64 having an axis 66. At the juncture of the first and second tubes is mirror 72 (shown in phantom) being set at an angle with respect to the two tubes that allow reflection of light parallel to the axis of the two tubes. Suitable lenses 74 and 76 are provided at the open ends of the tube. The joined ends of the first and second tubes form an angle 68 between the first tube 60 and second tube 64. Angle 68 is preferably 90° but can be at any desired angle. The length for the first tube 60 is sufficient to allow its insertions into the central passageway of the support member. The second tube 64 is of sufficient length to allow the eye piece 70 to be accessible by the user. Typically the length will be longer than the radius from the center of the bore to the outside of the breach. The length of the first tube is sufficient to provide true alignment with the axis of the baffle and the bore. This length is dependent upon the construction of the supporting baffle member. In the preferred multi-baffle embodiment the length is sufficient to reach from the first baffle to the second baffle. Alternatively, depending on the construction of the passageway in the baffle, alignment with a single baffle may be sufficient. The important criteria is that it be of such length to allow accurate alignment with the axis of the bore.

Figure 7:
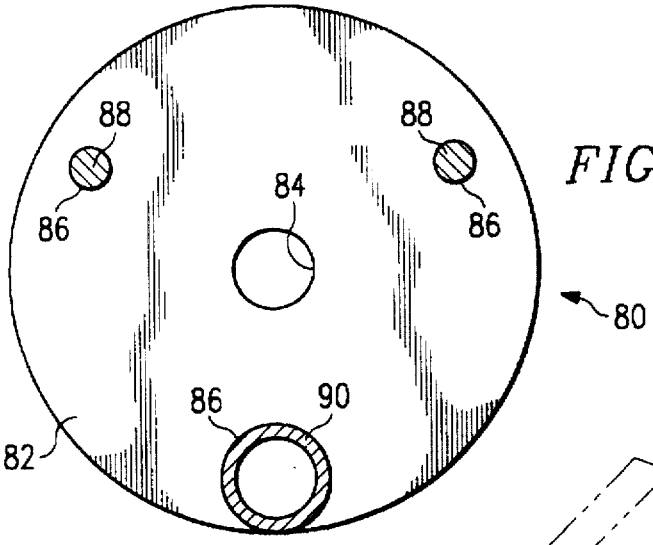
FIG. 7 is an end view of anther embodiment of the support assembly.

FIG. 7 is an end view of another embodiment of the support assembly 80 of the invention shown as a baffle plate 82 with a central passageway 84. Baffle 82 divides three connecting passageways 86. As can be seen in two of the connecting passageways 86 are smaller in diameter than the third larger passageway. Further, two of the passageways are disposed in from the outer perimeter of baffle 82 and two of the passageways are solid rod connecting members 88 and the third connecting passageway adjacent to the perimeter of baffle 82 is a hollow connecting tube 90. Connecting members 88 and 90 connect baffle 82 and 90 connect baffle 82 to a second space depart baffle not shown.

Figure 8:
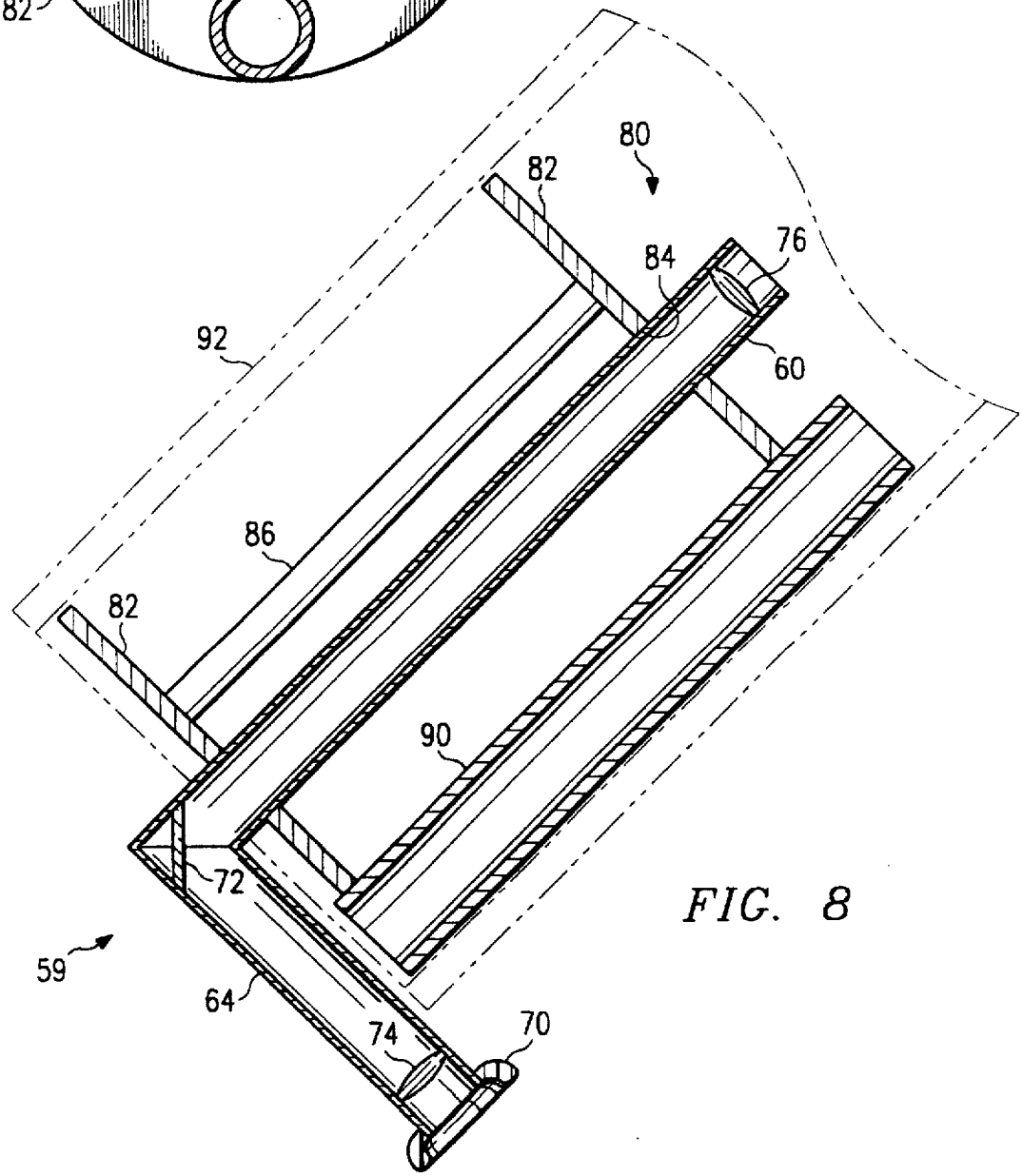
FIG. 8 is a cross-sectional view of one embodiment of the boresight having a supporting assembly and a sighting periscope.

FIG. 8 shows the barrel 92 of an artillery piece in phantom. Support assembly 80 is shown in place in the barrel together with sighting periscope 59 to form a boresight assembly. Sighting telescope 59 is past through passageway 84 and sights along the center of the bore of the artillery piece. Hollow connecting member 90 has sufficient inside diameter to receive sighting periscope 59. Once the center of the bore is aligned, the sighting periscope can be placed in connecting tube 90 which is located along the bottom of the bore. Thereafter, the artillery men can sight along the bottom of the bore and determine clear angles of fire.

In use the sighting support is inserted into the bore of the artillery piece. The periscope is inserted into the center passageway thus being combined to serve as a boresight. The artillery bore is moved until the periscope is centered on a predetermined point, such as an aiming board or a distant object. This indicates that the axis of the bore of the artillery piece is pointing directly at the point. Thereafter, the artillery tube is held steady and the direct fire sight of artillery piece is adjusted to be coordinated with the actual direction the bore is pointing. Thereafter, the panoramic sight scope of the artillery is adjusted to be aligned with the actual direction of the bore. The panoramic sight is used in conjunction with a reference point, such as an aiming stake for indirect fire as is well-known in the artillery.

The perimeter passageway is placed at the bottom of the bore of the artillery piece. The periscope is inserted in the passage and the minimum angle of fire (i.e., evaluation of the bore of the artillery piece is determined) to ensure clearance of obstructions. This is done by sighting along the lower edge of the bore to establish what elevation is required to have a clear field of fire within the possible radius of fire.

Thereafter, the bore sight assembly is removed and shells may be fired. The present invention can be made of any suitable material, such as steel. The outer wall can be coated with polytetraflouro ethylene, such as Teflon®, or other appropriate self-lubricating material to make insertion and removal of the baffles easier.

If desired in the multi-baffle device, the center passageway may be connected by a hollow connecting tube having an inside diameter dimensioned to receive the periscope.

The outside diameter of the periscope is sufficient that it will slidably engage the apertures of the baffles to allow its insertion and removal, and also allow rotation. Alternatively, the device may be made as a solid piece where the periscope is fixed to the support assembly. This is a less desirable configuration since the periscope is not easily rotated to accommodate the gunners use of the periscope sight.

I claim:

1. A sighting periscope support assembly comprising:

(a) two or more baffles defining a central passageway which permits unobstructed viewing therethrough, and three or more connecting channels;

(b) connecting members for connecting said baffles together and for holding them spaced apart from one another, said connecting members being engageable in said connecting channels.

2. The device of claim 1 wherein said baffles further define a perimeter passageway adjacent to the other wall of the baffles.

3. The device of claim 1 wherein at least one of said connecting members is a hollow tube.

4. A sighting periscope support assembly comprising:

a baffle defining a central passageway which permits an unobstructed vision therethrough and an outer wall and a perimeter passageway adjacent to the outer wall, said perimeter passageway being unobstructed to allow vision therethrough, said baffle having a diameter slightly less than the diameter of the bore of an artillery piece and a length of about two or more times the diameter of said bore.

5. A boresight assembly comprising:

(a) a baffle defining a central passageway permitting unobstructed viewing therethrough and an outer wall and a perimeter passageway adjacent to the outer wall, said perimeter passageway being unobstructed to prevent vision therethrough, said baffle having a diameter slightly less than the diameter of the bore of an artillery piece and a length of about two or more times the diameter; and (b) a sighting periscope having a first and second tube set at a predetermined angle, said periscope being dimensioned to be receivable within said passageways.

6. A boresight assembly comprising:

(a) a first baffle defining a central passageway, an outer wall, and three or more connecting channels;

(b) at least one additional baffle defining a central passageway, an outer wall, and three or more connecting channels:

(c) connecting members attached to the connecting channels of the said first baffle and extending therefrom and connected to said one or more additional baffles such that said one or more additional baffles are held spaced apart from said first baffle; and (d) a sighting periscope having first and second tubes set at a predetermined angle, said periscope being dimensioned to be receivable within said central passageway.

7. The assembly of claim 6 wherein one of said connecting members is a hollow tube having an inside diameter of sufficient size to receive said sighting periscope.

8. The assembly of claim 6 wherein said first baffle further defines a perimeter passageway adjacent to the outer wall of said baffle, and said at least one additional baffle defines a perimeter passageway adjacent to the outer wall of said at least one additional baffle.

9. The assembly of claim 6 wherein the outer of said baffles are spaced apart along said connecting members a distance of about two or more times the diameter of the bore an artillery piece.

* * * * *